US008252493B2

(12) United States Patent
Kumar et al.

(10) Patent No.: US 8,252,493 B2
(45) Date of Patent: Aug. 28, 2012

(54) TONER COMPOSITIONS

(75) Inventors: Samir Kumar, Pittsford, NY (US); Grazyna L. Kmiecik-Lawrynowicz, Fairport, NY (US); Maura A. Sweeney, Irondequoit, NY (US); Michael L. Grande, Palmyra, NY (US); Julie C. Pickering, Webster, NY (US); Timothy L. Lincoln, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 930 days.

(21) Appl. No.: 12/251,759

(22) Filed: Oct. 15, 2008

(65) Prior Publication Data

US 2010/0092884 A1 Apr. 15, 2010

(51) Int. Cl.
*G03G 9/08* (2006.01)

(52) U.S. Cl. ..... 430/108.11; 430/108.1; 430/108.22; 430/108.3; 430/108.4

(58) Field of Classification Search ..... 430/108.1, 430/108.11, 108.22, 108.3, 108.4
See application file for complete search history.

(56) References Cited

U.S. PATENT DOCUMENTS

| | | | |
|---|---|---|---|
| 2,874,063 | A | 2/1959 | Greig |
| 3,590,000 | A | 6/1971 | Palermiti et al. |
| 3,674,736 | A | 7/1972 | Lerman et al. |
| 3,800,588 | A | 4/1974 | Larson et al. |
| 4,265,990 | A | 5/1981 | Stolka et al. |
| 4,298,672 | A | 11/1981 | Lu |
| 4,338,390 | A | 7/1982 | Lu |
| 4,563,408 | A | 1/1986 | Lin et al. |
| 4,584,253 | A | 4/1986 | Lin et al. |
| 4,858,884 | A | 8/1989 | Harwath |
| 5,227,460 | A | 7/1993 | Mahabadi et al. |
| 5,236,629 | A | 8/1993 | Mahabadi et al. |
| 5,290,654 | A | 3/1994 | Sacripante et al. |
| 5,364,729 | A | 11/1994 | Kmiecik-Lawrynowicz et al. |
| 5,403,693 | A | 4/1995 | Patel et al. |
| 5,418,108 | A | 5/1995 | Kmiecik-Lawrynowicz et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,853,943 | A | 12/1998 | Cheng et al. |
| 6,063,827 | A | 5/2000 | Sacripante et al. |
| 6,214,507 | B1 | 4/2001 | Sokol et al. |
| 6,566,025 | B1 | 5/2003 | McStravick et al. |
| 6,593,049 | B1 | 7/2003 | Veregin et al. |
| 6,756,176 | B2 | 6/2004 | Stegamat et al. |
| 6,830,860 | B2 | 12/2004 | Sacripante et al. |
| 6,835,768 | B2 * | 12/2004 | Agur et al. ..... 524/487 |
| 6,878,498 | B2 * | 4/2005 | Yoshino et al. ..... 430/108.1 |
| 7,097,954 | B2 | 8/2006 | Hawkins et al. |
| 7,250,238 | B2 * | 7/2007 | Fromm et al. ..... 430/110.2 |
| 2004/0197693 | A1 * | 10/2004 | Ninomiya et al. ..... 430/108.7 |
| 2005/0031979 | A1 * | 2/2005 | Mc Stravick et al. .... 430/108.11 |
| 2006/0222991 | A1 | 10/2006 | Sacripante et al. |
| 2006/0269858 | A1 | 11/2006 | McDougall et al. |
| 2007/0048643 | A1 * | 3/2007 | Kmiecik-Lawrynowicz et al. ..... 430/108.6 |

OTHER PUBLICATIONS

European Search Report for EP 09 17 1649 dated Feb. 12, 2010.

* cited by examiner

*Primary Examiner* — Janis L Dote
(74) *Attorney, Agent, or Firm* — MDIP LLC

(57) ABSTRACT

Single component toners are provided with at least one surface additive including a large polymeric spacer, and processes for producing the same. In embodiments, the toner is a non-magnetic single component toner produced by emulsion aggregation methods. The large polymeric spacer additives provide excellent flow characteristics to the resulting toners, and reduce the incidence of clogging failure and print defects such as ghosting, white bands, and low toner density compared with conventionally produced toners.

12 Claims, 1 Drawing Sheet

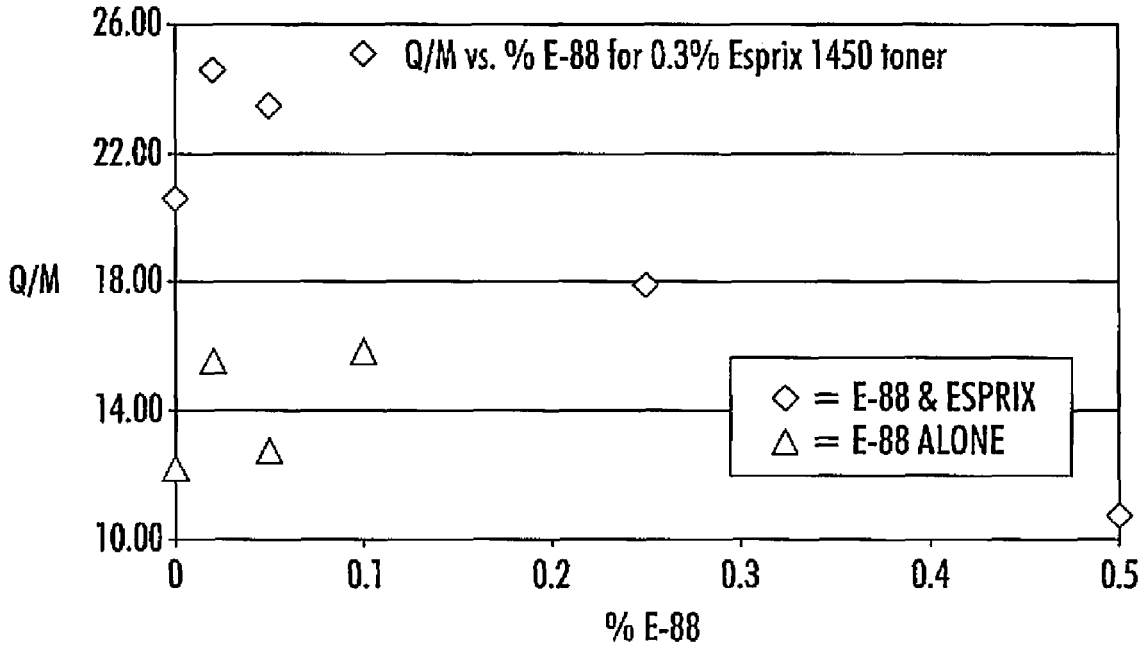
Q/M vs. % E-88 for 0.3% Esprix 1450 toner
26.00
22.00
18.00
14.00
10.00
Q/M
0
0.1
0.2
0.3
0.4
0.5
% E-88
◇ = E-88 & ESPRIX
△ = E-88 ALONE

TONER COMPOSITIONS

BACKGROUND

The present disclosure relates generally to toners and toner processes, and more specifically, to toner compositions possessing excellent charging properties and dispensing performance.

Numerous processes are known for the preparation of toners, such as, for example, conventional processes wherein a resin is melt kneaded or extruded with a pigment, micronized, and pulverized to provide toner particles. Toner can also be produced by emulsion aggregation methods. Methods of preparing an emulsion aggregation (EA) type toner are within the purview of those skilled in the art, and toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. Other examples of emulsion/aggregation/coalescing processes for the preparation of toners include those illustrated in U.S. Pat. Nos. 5,403,693, 5,418,108, 5,364,729, and 5,346,797, the disclosures of each of which are hereby incorporated by reference in their entirety. Other processes are disclosed in U.S. Pat. Nos. 5,527,658, 5,585,215, 5,650,255, 5,650,256 and 5,501,935, the disclosures of each of which are hereby incorporated by reference in their entirety.

Toner systems normally fall into two classes: two component systems, in which the developer material includes magnetic carrier granules having toner particles adhering triboelectrically thereto; and single component systems, which generally use only toner. Of the one-component development systems, both magnetic and non-magnetic systems are known. Magnetic systems involve the use of a toner containing a magnetic substance, which may preclude the development of sharp color images, which has led to a focus on non-magnetic systems.

The operating latitude of a powder electrophotographic development system may be determined to a great degree by the ease with which toner particles may be supplied to an electrostatic image. Placing charge on the particles, to enable movement and development of images via electric fields, is often accomplished with triboelectricity. Triboelectric charging may occur either by mixing the toner with larger carrier beads in a two component development (TCD) system, or by rubbing the toner between a blade and donor roll in a single component development (SCD) system.

With non-magnetic SCD, toner is supplied from a toner house to the supply roll and then to the development roll. The toner is charged while it passes a charging/metering blade. Non-magnetic SCD has been very popular for desk top color laser printers due to its compact size, since it does not need carrier in the development housing to charge toner. Non-magnetic SCD systems may thus utilize cartridges that are smaller in size compared with TCD systems, and the cost to a customer to replace a unit may, in some cases, be lower for a single component development system compared with a two component system.

There are several issues associated with SCD. The first is low charge and broad charge distribution on toner particles compared with conventional TCD toner. This is because the time for toner to flow through the gap between the blade and the development roll is very short. Low charge causes high background and low developability. Toner for SCD also has a high fines content, which may affect the charge and the print background. Also, the higher the fines content, the broader the charge distribution.

Another issue with SCD includes toner robustness in aging and in extreme environments such as A and C zone conditions found in an electrophotographic apparatus. The high stress under the blade may cause the toner to stick to the blade or the development roll. This may reduce the toner charge and the toner flowability. Since non-magnetic toner is charged through a charging/metering blade, low charging and low flowability can cause print defects such as ghosting, white bands, and low toner density on images.

Hence, toner compositions with excellent charging characteristics and excellent dispensing performance remain desirable.

SUMMARY

The present disclosure provides toner compositions and processes for producing same. In embodiments, a toner of the present disclosure may include a single component toner including a latex resin, and at least one surface additive including a large polymeric spacer having a volume average diameter of from about 100 nm to about 500 nm.

In other embodiments, a toner of the present disclosure may include a single component toner including a latex resin such as styrene acrylates, styrene butadienes, styrene methacrylates, and combinations thereof, and at least one surface additive including a large polymeric spacer such as polystyrenes, fluorocarbons, polyurethanes, polyolefins, polyesters, and combinations thereof, having a volume average diameter of from about 90 nm to about 700 nm.

A process of the present disclosure may include contacting at least one latex resin in a dispersion with an optional colorant, an optional surfactant, and an optional wax to form small particles, aggregating the small particles, coalescing the small particles to form toner particles, and combining with the toner particles at least at least one surface additive including a large polymeric spacer such as polystyrenes, fluorocarbons, polyurethanes, polyolefins, polyesters, and combinations thereof, having a volume average diameter of from about 90 nm to about 700 nm, and recovering the toner particles.

BRIEF DESCRIPTION OF THE FIGURES

Various embodiments of the present disclosure will be described herein below with reference to the figures wherein:

The FIGURE is a graph of print testing data, more specifically the parent toner charge per mass ratio (Q/M) off the developer roll, for a toner of the present disclosure having a large polymeric spacer surface additive, compared with a control toner.

DETAILED DESCRIPTION

The present disclosure provides a toner suitable for use in a single component development system which possesses excellent charging and flow characteristics. The toners of the present disclosure contain very large polymeric spacer additives as surface additives, optionally in combination with organic charge control agents as surface additives, which provide excellent flow characteristics to the resulting toners, and reduce the incidence of clogging failure and print defects such as ghosting, white bands, and low toner density compared with conventionally produced toners.

Toners of the present disclosure may include a latex resin in combination with a pigment. While the latex resin may be prepared by any method within the purview of those skilled in the art, in embodiments the latex resin may be prepared by emulsion polymerization methods, including semi-continuous emulsion polymerization, and the toner may include emulsion aggregation toners. Emulsion aggregation involves aggregation of both submicron latex and pigment particles into toner size particles, where the growth in particle size is, for example, in embodiments from about 0.1 micron to about 15 microns.

Resin

Any monomer suitable for preparing a latex for use in a toner may be utilized. Such latexes may be produced by conventional methods. As noted above, in some embodiments the toner may be produced by emulsion aggregation. Suitable monomers useful in forming a latex emulsion, and thus the resulting latex particles in the latex emulsion, include, but are not limited to, styrenes, acrylates, methacrylates, butadienes, isoprenes, acrylic acids, methacrylic acids, acrylonitriles, combinations thereof, and the like.

In embodiments, the resin of the latex may include at least one polymer. In embodiments, at least one may be from about one to about twenty and, in embodiments, from about three to about ten. Exemplary polymers include styrene acrylates, styrene butadienes, styrene methacrylates, and more specifically, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid), and combinations thereof. The polymer may be block, random, or alternating copolymers.

In embodiments, a poly(styrene-butyl acrylate) may be utilized as the latex. The glass transition temperature of this latex may be from about 35° C. to about 75° C., in embodiments from about 40° C. to about 70° C.

In other embodiments, the polymer utilized to form the latex may be a polyester resin, including the resins described in U.S. Pat. Nos. 6,593,049 and 6,756,176, the disclosures of each of which are hereby incorporated by reference in their entirety. The polyesters may be amorphous, crystalline, or both. Suitable amorphous resins include those disclosed in U.S. Pat. No. 6,063,827, the disclosure of which is hereby incorporated by reference in its entirety. Suitable crystalline resins include those disclosed in U.S. Patent Application Publication No. 2006/0222991, the disclosure of which is hereby incorporated by reference in its entirety. Suitable latexes may also include a mixture of an amorphous polyester resin and a crystalline polyester resin as described in U.S. Pat. No. 6,830,860, the disclosure of which is hereby incorporated by reference in its entirety.

In addition, polyester resins obtained from the reaction products of bisphenol A and propylene oxide or propylene carbonate, and in particular including such polyesters followed by the reaction of the resulting product with fumaric acid (as disclosed in U.S. Pat. No. 5,227,460, the disclosure of which is hereby incorporated by reference in its entirety), and branched polyester resins resulting from the reaction of dimethylterephthalate with 1,3-butanediol, 1,2-propanediol, and pentaerythritol, may also be used.

In embodiments, an unsaturated polyester resin may be utilized as a latex resin. Examples of such resins include those disclosed in U.S. Pat. No. 6,063,827, the disclosure of which is hereby incorporated by reference in its entirety. Exemplary unsaturated polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly (propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

An example of a linear propoxylated bisphenol A fumarate resin which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C. and the like.

Surfactants

In embodiments, the latex resin may be prepared in an aqueous phase containing a surfactant or co-surfactant. Surfactants which may be utilized with the resin to form a latex dispersion can be ionic or nonionic surfactants in an amount of from about 0.01 to about 15 weight percent of the solids, and in embodiments of from about 0.1 to about 10 weight percent of the solids.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abietic acid available from Aldrich, NEOGEN R™, NEOGEN SC™ obtained from Daiichi Kogyo Seiyaku Co., Ltd., combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, C12, C15, C17 trimethyl ammonium bromides, combinations thereof, and the like. Other cationic surfactants include cetyl pyridinium bromide, halide salts of quaternized polyoxyethylalkylamines, dodecylbenzyl triethyl ammonium chloride, MIRAPOL and ALKAQUAT available from Alkaril Chemical Company, SANISOL (benzalkonium chloride), available from Kao Chemicals, combinations thereof, and the like. In embodiments a suitable cationic surfactant includes SANISOL B-50 available from Kao Corp., which is primarily a benzyl dimethyl alkonium chloride.

Examples of nonionic surfactants include, but are not limited to, alcohols, acids and ethers, for example, polyvinyl alcohol, polyacrylic acid, methalose, methyl cellulose, ethyl cellulose, propyl cellulose, hydroxyl ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, combinations thereof, and the like. In embodiments commercially available surfactants from Rhone-Poulenc such as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ can be utilized.

The choice of particular surfactants or combinations thereof, as well as the amounts of each to be used, are within the purview of those skilled in the art.

Initiators

In embodiments initiators may be added for formation of the latex. Examples of suitable initiators include water soluble initiators, such as ammonium persulfate, sodium persulfate and potassium persulfate, and organic soluble initiators including organic peroxides and azo compounds including Vazo peroxides, such as VAZO 64™2-methyl 2-2'-azobis propanenitrile, VAZO 88™, 2-2'-azobis isobutyramide dehydrate, and combinations thereof. Other water-soluble initiators which may be utilized include azoamidine compounds, for example 2,2'-azobis(2-methyl-N-phenylpropionamidine) dihydrochloride, 2,2'-azobis[N-(4-chlorophenyl)-2-methylpropionamidine]di-hydrochloride, 2,2'-azobis[N-(4-hydroxyphenyl)-2-methyl-propionamidine]dihydrochloride, 2,2'-azobis[N-(4-amino-phenyl)-2-methylpropionamidine] tetrahydrochloride, 2,2'-azobis[2-methyl-N(phenylmethyl) propionamidine]dihydrochloride, 2,2'-azobis[2-methyl-N-2-propenylpropionamidine]dihydrochloride, 2,2'-azobis[N-(2-hydroxy-ethyl)2-methylpropionamidine]dihydrochloride, 2,2'-azobis[2(5-methyl-2-imidazolin-2-yl)propane]dihydrochloride, 2,2'-azobis[2-(2-imidazolin-2-yl)propane]dihydrochloride, 2,2'-azobis[2-(4,5,6,7-tetrahydro-1H-1,3-diazepin-2-yl)propane]dihydrochloride, 2,2'-azobis[2-(3,4,5,6-tetrahydropyrimidin-2-yl)propane]dihydrochloride, 2,2'-azobis[2-(5-hydroxy-3,4,5,6-tetrahydropyrimidin-2-yl) propane]dihydrochloride, 2,2'-azobis {2-[1-(2-hydroxyethyl)-2-imidazolin-2-yl]propane}dihydrochloride, combinations thereof, and the like.

Initiators can be added in suitable amounts, such as from about 0.1 to about 8 weight percent, and in embodiments of from about 0.2 to about 5 weight percent of the monomers.

Chain Transfer Agents

In embodiments, chain transfer agents may also be utilized in forming the latex. Suitable chain transfer agents include dodecane thiol, octane thiol, carbon tetrabromide, combinations thereof, and the like, in amounts from about 0.1 to about 10 percent and, in embodiments, from about 0.2 to about 5 percent by weight of monomers, to control the molecular weight properties of the polymer when emulsion polymerization is conducted in accordance with the present disclosure.

Stabilizers

In embodiments, it may be advantageous to include a stabilizer when forming the latex particles. Suitable stabilizers include monomers having carboxylic acid functionality. Such stabilizers may be of the following formula (1):

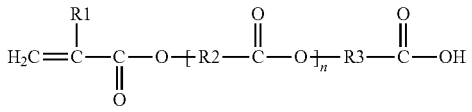

(I)

where R1 is hydrogen or a methyl group; R2 and R3 are independently selected from alkyl groups containing from about 1 to about 12 carbon atoms or a phenyl group; n is from about 0 to about 20, in embodiments from about 1 to about 10. Examples of such stabilizers include beta carboxyethyl acrylate (β-CEA), poly(2-carboxyethyl) acrylate, 2-carboxyethyl methacrylate, combinations thereof, and the like. Other stabilizers which may be utilized include, for example, acrylic acid and its derivatives.

In embodiments, the stabilizer having carboxylic acid functionality may also contain a small amount of metallic ions, such as sodium, potassium and/or calcium, to achieve better emulsion polymerization results. The metallic ions may be present in an amount from about 0.001 to about 10 percent by weight of the stabilizer having carboxylic acid functionality, in embodiments from about 0.5 to about 5 percent by weight of the stabilizer having carboxylic acid functionality.

Where present, the stabilizer may be added in amounts from about 0.01 to about 5 percent by weight of the toner, in embodiments from about 0.05 to about 2 percent by weight of the toner.

Additional stabilizers that may be utilized in the toner formulation processes include bases such as metal hydroxides, including sodium hydroxide, potassium hydroxide, ammonium hydroxide, and optionally combinations thereof. Also useful as a stabilizer is sodium carbonate, sodium bicarbonate, calcium carbonate, potassium carbonate, ammonium carbonate, combinations thereof, and the like. In embodiments a stabilizer may include a composition containing sodium silicate dissolved in sodium hydroxide.

pH Adjustment Agent

In some embodiments a pH adjustment agent may be added to control the rate of the emulsion aggregation process. The pH adjustment agent utilized in the processes of the present disclosure can be any acid or base that does not adversely affect the products being produced. Suitable bases can include metal hydroxides, such as sodium hydroxide, potassium hydroxide, ammonium hydroxide, and optionally combinations thereof. Suitable acids include nitric acid, sulfuric acid, hydrochloric acid, citric acid, acetic acid, and optionally combinations thereof.

Reaction Conditions

In the emulsion aggregation process, the reactants may be added to a suitable reactor, such as a mixing vessel. The appropriate amount of at least two monomers, in embodiments from about two to about ten monomers, stabilizer, surfactant(s), initiator, if any, chain transfer agent, if any, and wax, if any, and the like may be combined in the reactor and the emulsion aggregation process may be allowed to begin. Suitable waxes are described in greater detail below as a component to be added in the formation of a toner particle; such waxes may also be useful, in embodiments, in forming a latex resin. Reaction conditions selected for effecting the emulsion polymerization include temperatures of, for example, from about 45° C. to about 120° C., in embodiments from about 60° C. to about 90° C. In embodiments the polymerization may occur at elevated temperatures within about 10 percent of the melting point of any wax present, for example from about 60° C. to about 85° C., in embodiments from about 65° C. to about 80° C., to permit the wax to soften thereby promoting dispersion and incorporation into the emulsion.

Nanometer size particles may be formed having a size of from about 50 nm to about 800 nm in volume average diameter, in embodiments from about 100 nm to about 400 nm in volume average diameter, as determined, for example, by a Brookhaven nanosize particle analyzer.

After formation of the latex particles, the latex particles may be utilized to form a toner. In embodiments, the toners may be an emulsion aggregation type toner that are prepared by the aggregation and fusion of the latex particles of the present disclosure with a colorant, and one or more additives such as surfactants, stabilizers, coagulants, waxes, surface additives, and optionally combinations thereof.

Other processes for obtaining resin particles include those produced by a polymer microsuspension process as disclosed in U.S. Pat. No. 3,674,736, the disclosure of which is hereby incorporated by reference in its entirety, a polymer solution microsuspension process as disclosed in U.S. Pat. No. 5,290,654, the disclosure of which is hereby incorporated by reference in its entirety, and mechanical grinding processes, or other processes within the purview of those skilled in the art.

Colorants

The latex particles produced as described above may be added to a colorant to produce a toner. In embodiments the colorant may be in a dispersion. The colorant dispersion may include, for example, submicron colorant particles having a size of, for example, from about 50 to about 500 nanometers in volume average diameter and, in embodiments, of from about 100 to about 400 nanometers in volume average diameter. The colorant particles may be suspended in an aqueous water phase containing an anionic surfactant, a nonionic surfactant, or combinations thereof. Suitable surfactants include any of those surfactants described above. In embodiments, the surfactant may be ionic and may be present in a dispersion in an amount from about 0.1 to about 25 percent by weight of the colorant, and in embodiments from about 1 to about 15 percent by weight of the colorant.

Colorants useful in forming toners in accordance with the present disclosure include pigments, dyes, mixtures of pigments and dyes, mixtures of pigments, mixtures of dyes, and the like. The colorant may be, for example, carbon black, cyan, yellow, magenta, red, orange, brown, green, blue, violet, and/or combinations thereof.

In embodiments wherein the colorant is a pigment, the pigment may be, for example, carbon black, phthalocyanines, quinacridones or RHODAMINE B™ type, red, green, orange, brown, violet, yellow, fluorescent colorants, and the like.

Exemplary colorants include carbon black like REGAL 330® magnetites; Mobay magnetites including MO8029™, MO8060™; Columbian magnetites; MAPICO BLACKS™ and surface treated magnetites; Pfizer magnetites including CB4799™, CB5300™, CB5600™, MCX6369™; Bayer magnetites including, BAYFERROX 8600™, 8610™; Northern Pigment magnetites including, NP-604™, NP-608™; Magnox magnetites including TMB-100™, or TMB-104™, HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc.; PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company. Other colorants include 2,9-dimethyl-substituted quinacridone and anthraquinone dye identified in the Color Index as CI 60710, CI Dispersed Red 15, diazo dye identified in the Color Index as CI 26050, CI Solvent Red 19, copper tetra(octadecyl sulfonamido) phthalocyanine, x-copper phthalocyanine pigment listed in the Color Index as CI 74160, CI Pigment Blue, Anthrathrene Blue identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonamide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, combinations of any of the foregoing, and the like. The dyes may be utilized in various suitable amounts, for example from about 0.5 to about 20 percent by weight of the toner, in embodiments, from about 5 to about 18 weight percent of the toner.

In embodiments, colorant examples include Pigment Blue 15:3 having a Color Index Constitution Number of 74160, Magenta Pigment Red 81:3 having a Color Index Constitution Number of 45160:3, Yellow 17 having a Color Index Constitution Number of 21105, and known dyes such as food dyes, yellow, blue, green, red, magenta dyes, and the like.

In other embodiments, a magenta pigment, Pigment Red 122 (2,9-dimethylquinacridone), Pigment Red 185, Pigment Red 192, Pigment Red 202, Pigment Red 206, Pigment Red 235, Pigment Red 269, combinations thereof, and the like, may be utilized as the colorant.

The colorant may be present in the toner of the disclosure in an amount of from about 1 to about 25 percent by weight of toner, in embodiments in an amount of from about 2 to about 15 percent by weight of the toner.

The resulting latex, optionally in a dispersion, and colorant dispersion may be stirred and heated to a temperature of from about 35° C. to about 70° C., in embodiments of from about 40° C. to about 65° C., resulting in toner aggregates of from about 2 microns to about 10 microns in volume average diameter, and in embodiments of from about 5 microns to about 8 microns in volume average diameter.

Coagulants

In embodiments, a coagulant may be added during or prior to aggregating the latex and the aqueous colorant dispersion. The coagulant may be added over a period of time from about 1 minute to about 60 minutes, in embodiments from about 1.25 minutes to about 20 minutes, depending on the processing conditions.

Examples of suitable coagulants include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, combinations thereof, and the like. One suitable coagulant is PAC, which is commercially available and can be prepared by the controlled hydrolysis of aluminum chloride with sodium hydroxide. Generally, PAC can be prepared by the addition of two moles of a base to one mole of aluminum chloride. The species is soluble and stable when dissolved and stored under acidic conditions if the pH is less than about 5. The species in solution is believed to contain the formula $Al_{13}O_4(OH)_{24}(H_2O)_{12}$ with about 7 positive electrical charges per unit.

In embodiments, suitable coagulants include a polymetal salt such as, for example, polyaluminum chloride (PAC), polyaluminum bromide, or polyaluminum sulfosilicate. The polymetal salt can be in a solution of nitric acid, or other diluted acid solutions such as sulfuric acid, hydrochloric acid, citric acid or acetic acid. The coagulant may be added in amounts from about 0.01 to about 5 percent by weight of the toner, and in embodiments from about 0.1 to about 3 percent by weight of the toner.

Wax

Wax dispersions may also be added during formation of a latex or toner in an emulsion aggregation synthesis. Suitable waxes include, for example, submicron wax particles in the size range of from about 50 to about 1000 nanometers, in embodiments of from about 100 to about 500 nanometers in volume average diameter, suspended in an aqueous phase of water and an ionic surfactant, nonionic surfactant, or combinations thereof. Suitable surfactants include those described above. The ionic surfactant or nonionic surfactant may be present in an amount of from about 0.1 to about 20 percent by weight, and in embodiments of from about 0.5 to about 15 percent by weight of the wax.

The wax dispersion according to embodiments of the present disclosure may include, for example, a natural vegetable wax, natural animal wax, mineral wax, and/or synthetic wax. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax, and combinations thereof.

Examples of polypropylene and polyethylene waxes include those commercially available from Allied Chemical and Baker Petrolite, wax emulsions available from Michelman Inc. and the Daniels Products Company, EPOLENE N-15 commercially available from Eastman Chemical Products, Inc., VISCOL 550-P, a low weight average molecular weight polypropylene available from Sanyo Kasel K. K., and similar materials. In embodiments, commercially available polyethylene waxes possess a molecular weight (Mw) of from about 100 to about 5000, and in embodiments of from about 250 to about 2500, while the commercially available polypropylene waxes have a molecular weight of from about 200 to about 10,000, and in embodiments of from about 400 to about 5000.

In embodiments, the waxes may be functionalized. Examples of groups added to functionalize waxes include amines, amides, imides, esters, quaternary amines, and/or carboxylic acids. In embodiments, the functionalized waxes may be acrylic polymer emulsions, for example, JONCRYL 74, 89, 130, 537, and 538, all available from Johnson Diversey, Inc, or chlorinated polypropylenes and polyethylenes commercially available from Allied Chemical, Baker Petrolite Corporation and Johnson Diversey, Inc.

The wax may be present in an amount of from about 0.1 to about 30 percent by weight, and in embodiments from about 2 to about 20 percent by weight of the toner.

Aggregating Agents

Any aggregating agent capable of causing complexation might be used in forming toners of the present disclosure. Both alkali earth metal or transition metal salts can be utilized as aggregating agents. In embodiments, alkali (II) salts can be selected to aggregate latex resin colloids with a colorant to enable the formation of a toner composite. Such salts include, for example, beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and optionally combinations thereof. Examples of transition metal salts or anions which may be utilized as aggregating agent include acetates of vanadium, niobium, tantalum, chromium, molybdenum, tungsten, manganese, iron, ruthenium, cobalt, nickel, copper, zinc, cadmium or silver; acetoacetates of vanadium, niobium, tantalum, chromium, molybdenum, tungsten, manganese, iron, ruthenium, cobalt, nickel, copper, zinc, cadmium or silver; sulfates of vanadium, niobium, tantalum, chromium, molybdenum, tungsten, manganese, iron, ruthenium, cobalt, nickel, copper, zinc, cadmium or silver; and aluminum salts such as aluminum acetate, aluminum halides such as polyaluminum chloride, combinations thereof, and the like.

pH Adjustment Agent

In some embodiments a pH adjustment agent may be added to the latex, colorant, and optional additives, to control the rate of the emulsion aggregation process. The pH adjustment agent utilized in the processes of the present disclosure can be any acid or base that does not adversely affect the products being produced. Suitable bases can include metal hydroxides, such as sodium hydroxide, potassium hydroxide, ammonium hydroxide, and optionally combinations thereof. Suitable acids include nitric acid, sulfuric acid, hydrochloric acid, citric acid, acetic acid, and optionally combinations thereof.

Once the desired final size of the toner particles is achieved, the pH of the mixture may be adjusted with a base to a value of from about 3.5 to about 7, and in embodiments from about 4 to about 6.5. The base may include any suitable base such as, for example, alkali metal hydroxides such as, for example, sodium hydroxide, potassium hydroxide, and ammonium hydroxide. The alkali metal hydroxide may be added in amounts from about 0.1 to about 30 percent by weight of the mixture, in embodiments from about 0.5 to about 15 percent by weight of the mixture.

The resultant blend of latex, optionally in a dispersion, stabilizer, optional wax, colorant dispersion, optional coagulant, and optional aggregating agent, may then be stirred and heated to a temperature below the Tg of the latex, in embodiments from about 30° C. to about 70° C., in embodiments of from about 35° C. to about 65° C., for a period of time of from about 0.2 hours to about 6 hours, in embodiments from about 0.3 hours to about 5 hours, to form aggregated particles.

In embodiments, an optional shell may then be formed on the aggregated particles, prior to coalescence. Where used, the shell latex may be applied by any method within the purview of those skilled in the art, including dipping, spraying, and the like. In embodiments, a shell may be applied by adding additional latex to the aggregated particles and allowing this additional latex to aggregate on the surface of the particles, thereby forming a shell thereover. Any resin within the purview of those skilled in the art, including those resins described above, may be utilized as a shell latex. In embodiments, a styrene-n-butyl acrylate copolymer may be utilized to form the shell latex. In embodiments, the latex utilized to form the shell may have a glass transition temperature of from about 35° C. to about 75° C., in embodiments from about 40° C. to about 70° C.

The shell latex may be applied until the desired final size of the toner particles is achieved, in embodiments from about 2 microns to about 10 microns, in other embodiments from about 4 microns to about 8 microns.

Coalescence

The aggregated particles are subsequently coalesced. Coalescing may include stirring and heating at a temperature of from about 80° C. to about 99° C., for a period of from about 0.5 to about 12 hours, and in embodiments from about 1 to about 6 hours. Coalescing may be accelerated by additional stirring.

In embodiments, a transition metal powder and/or a transition metal salt may be added to the mixture of latex, colorant, optional wax, and any additives, at the beginning of the coalescence process. Suitable metals include, for example, copper, zinc, iron, cobalt, nickel, molybdenum, manganese, chromium, vanadium, and/or titanium, as well as metal alloys such as copper/zinc alloys.

Subsequent Treatments

In embodiments, the pH of the mixture may then be lowered to from about 3.5 to about 6 and, in embodiments, to from about 3.7 to about 5.5 with, for example, an acid, to further coalesce the toner aggregates. Suitable acids include, for example, nitric acid, sulfuric acid, hydrochloric acid, citric acid and/or acetic acid. The amount of acid added may be from about 0.1 to about 30 percent by weight of the mixture, and in embodiments from about 1 to about 20 percent by weight of the mixture.

The mixture may be cooled, washed and dried. Cooling may be at a temperature of from about 20° C. to about 40° C., in embodiments from about 22° C. to about 30° C., over a period of time of from about 1 hour to about 8 hours, in embodiments from about 1.5 hours to about 5 hours.

In embodiments, cooling a coalesced toner slurry may include quenching by adding a cooling media such as, for example, ice, dry ice and the like, to effect rapid cooling to a temperature of from about 20° C. to about 40° C., in embodiments of from about 22° C. to about 30° C. Quenching may be feasible for small quantities of toner, such as, for example, less than about 2 liters, in embodiments from about 0.1 liters to about 1.5 liters. For larger scale processes, such as for example greater than about 10 liters in size, rapid cooling of the toner mixture may not be feasible or practical, neither by the introduction of a cooling medium into the toner mixture, or by the use of jacketed reactor cooling.

The toner slurry may then be washed. The washing may be carried out at a pH of from about 7 to about 12, in embodiments at a pH of from about 9 to about 11. The washing may be at a temperature of from about 30° C. to about 70° C., in embodiments from about 40° C. to about 67° C. The washing may include filtering and reslurrying a filter cake including toner particles in deionized water. The filter cake may be washed one or more times by deionized water, or washed by a single deionized water wash at a pH of about 4 wherein the pH of the slurry is adjusted with an acid, and followed optionally by one or more deionized water washes.

Drying may be carried out at a temperature of from about 35° C. to about 75° C., and in embodiments of from about 45° C. to about 60° C. The drying may be continued until the moisture level of the particles is below a set target of about 1% by weight, in embodiments of less than about 0.7% by weight.

Spacers

In embodiments, toner particles formed as described above may have spacer molecules added thereto as a surface additive. In embodiments, such additives may be added after coalescence. For example, large polymeric surface additives may be included with a toner composition of the present disclosure as a spacer to prevent toner particles sticking to the development roll, thereby reducing the incidence of print defects such as ghosting, white bands, and low toner density on images. As used herein, large polymeric surface additives, also referred to herein, in embodiments, as large polymeric spacers, may have a volume average diameter of from about 90 nm to about 700 nm, in embodiments from about 100 nm to about 300 nm.

Suitable large polymeric spacers include, in embodiments, polymers such as polystyrenes, fluorocarbons, polyurethanes, polyolefins including high molecular weight polymethylenes, high molecular weight polyethylenes, and high molecular weight polypropylenes, and polyesters including acrylates, methacrylates, methylmethacrylates, and combinations thereof. Specific large polymeric spacers which may be utilized include polymethyl methacrylate, styrene acrylates, polystyrene, fluorinated methacrylates, fluorinated polymethyl methacrylates, and combinations thereof.

The large polymeric spacers may be added so that they are present in an amount of from about 0.01% to about 1.25% by weight of the toner particles, in embodiments from about 0.1% to about 1% by weight of the toner particles.

In some embodiments, the large polymeric spacers may be subjected to surface treatments. Such treatments include, for example, the application of silicon, zinc, combinations thereof, and the like, to the large polymeric spacer particles. In embodiments, silicon and zinc may be combined and added to the surface of a large polymeric spacer with the silicon present in an amount of from about 40 ppm to about 120 ppm, in embodiments from about 90 ppm to about 100 ppm, and the zinc may be present in an amount of from about 1200 ppm to about 4000 ppm, in embodiments from about 2700 ppm to about 3000 ppm. The ratio of silicon to zinc may thus be from about 1:2 to about 1:8, in embodiments from about 1:3 to about 1:5.

Other suitable surface treatments for the large polymeric spacer include coatings such as silicone oils, siloxanes including polydimethylsiloxane, octamethylcyclotetrasiloxane, silanes including—γ-amino tri-methoxy silane, and dimethyldichlorosilane (DDS), silazanes including hexamethyldisilazane (HMDS), other silicon compounds such as dimethyloctadecyl-3-trimethoxy (silyl) propyl ammonium chloride, as well as metal salicylates utilizing metals such as iron, zinc, aluminum, magnesium, and combinations thereof.

Large polymeric spacers may be combined with toner particles utilizing any method within the purview of those skilled in the art, including blending, mixing, roll milling, combinations thereof, and the like, so that the large polymeric spacers become attached to the surface of the toner particles. In embodiments, large polymeric spacers may be combined with toner particles by mixing at a speed of from about 800 revolutions per minute (rpm) to about 3800 rpm, in embodiments from about 1400 rpm to about 3200 rpm, for a period of time of from about 5 minutes to about 25 minutes, in embodiments from about 7 minutes to about 15 minutes.

The resulting particles with spacers may possess a surface area of from about 0.80 $m^2/g$ to about 3.5 $m^2/g$, in embodiments from about 0.98 $m^2/g$ to about 1.5 $m^2/g$, as determined by the Brunauer, Emmett and Teller (BET) method.

Other Additives

In embodiments, the toner particles may also contain other optional additives, as desired or required. For example, the toner may include additional positive or negative charge control agents, for example in an amount of from about 0.1 to about 10 percent by weight of the toner, in embodiments from about 1 to about 3 percent by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts including such as BONTRON® E-84 or BONTRON® E-88 (Hodogaya Chemical); combinations thereof, and the like. BONTRON® E-84 is a zinc complex of 3,5-di-tert-butylsalicylic acid in powder form. BONTRON® E-88 is a mixture of hydroxyaluminum-bis[2-hydroxy-3,5-di-tert-butylbenzoate] and 3,5-di-tert-butylsalicylic acid.

There can also be blended with the toner particles external additive particles including flow aid additives, which additives may be present on the surface of the toner particles. Examples of these additives include metal oxides such as titanium oxide, titanium dioxide, silicon oxide, silicon dioxide, tin oxide, mixtures thereof, and the like; colloidal and amorphous silicas, such as AEROSIL®, metal salts and metal salts of fatty acids inclusive of zinc stearate, strontium stearate, calcium stearate, aluminum oxides, cerium oxides, and mixtures thereof. Each of these external additives may be present in an amount of from about 0.1 percent by weight to about 5 percent by weight of the toner, in embodiments of from about 0.25 percent by weight to about 3 percent by weight of the toner. Suitable additives include those disclosed in U.S. Pat. Nos. 3,590,000, 3,800,588, and 6,214,507, the disclosures of each of which are hereby incorporated by reference in their entirety.

In embodiments, the size of the additives utilized may vary. Thus, in embodiments, an additive utilized in addition to the large polymeric spacer described above may have a volume average diameter of from about 5 nm to about 600 nm, depending upon the additive. For example, small silica may have a volume average diameter of from about 5 nm to about 20 nm; medium silica may have a volume average diameter of from about 30 nm to about 50 nm; large silica may have a volume average diameter of from about 60 nm to about 180 nm; small titania may have a volume average diameter of from about 10 nm to about 30 nm; medium titania may have a volume average diameter of from about 40 nm to about 70 nm; large titania may have a volume average diameter of from about 80 nm to about 150 nm; aluminum oxide may have a volume average diameter of from about 13 nm to about 100 nm; cerium oxide may have a volume average diameter of from about 300 nm to about 600 nm; and strontium titanate may have a volume average diameter of from about 50 nm to about 200 nm.

Zinc stearate and calcium stearate may be larger, with a volume average diameter of from about from about 200 nm to about 10 μm, in embodiments about 1 μm.

Where additional additives are utilized in addition to the large polymeric spacer, the large polymeric spacer may be present in an amount from about 0.05% to about 1% by weight of the toner, in embodiments from about 0.1% to about 0.5% by weight of the toner, while the second additive may be present in an amount from about 0.05% to about 0.8% by weight of the toner, in embodiments from about 0.1% to about 0.3% by weight of the toner. In embodiments, third or more additives may be included, for example titanium dioxide for control of relative humidity characteristics, in an amount of from about 0.01% to about 0.3% by weight of the toner, in embodiments from about 0.05% to about 0.15%. Other additives may also be used in the blend depending upon the desired performance and hardware interactions.

The above surface additives may be utilized to optimize charging and charge distribution of a toner. For example, the large polymeric spacers herein may act as a spacer to prevent toner sticking to the development roll, thereby reducing the incidence of print defects such as ghosting, white bands, and low toner density on images.

In embodiments, the blending of large polymeric spacers, optionally in combination with other additives may impart triboelectric charges to the toner. Toners of the present disclosure may thus have a triboelectric charge at from about 40 μC/g to about 90 μC/g, in embodiments from about 50 μC/g to about 80 μC/g.

As the charging of the toner particles may be enhanced, less surface additives may be required, and the final toner charging may thus be higher to meet machine charging requirements.

Toner Particles

Toners produced in accordance with the present disclosure may possess excellent charging characteristics when exposed to extreme relative humidity (RH) conditions. The low-humidity zone (C zone) is about 10° C./15% RH, while the high humidity zone (A zone) is about 28° C./85% RH. Toners of the present disclosure may also possess a parent toner charge per mass ratio (Q/M) of from about −3 μC/g to about −35 μC/g, and a final toner charging after surface additive blending of from −5 μC/g to about −50 μC/g.

The melt flow index (MFI) of toners produced in accordance with the present disclosure may be determined by methods within the purview of those skilled in the art, including the use of a plastometer. For example, the MFI of the toner may be measured on a Tinius Olsen extrusion plastometer at about 125° C. with about 5 kilograms load force. Samples may then be dispensed into the heated barrel of the melt indexer, equilibrated for an appropriate time, in embodiments from about five minutes to about seven minutes, and then the load force of about 5 kg may be applied to the melt indexer's piston. The applied load on the piston forces the molten sample out a predetermined orifice opening. The time for the test may be determined when the piston traveled one inch.

The melt flow may be calculated by the use of the time, distance, and weight volume extracted during the testing procedure.

MFI as used herein thus includes, in embodiments, for example, the weight of a toner (in grams) which passes through an orifice of length L and diameter D in a 10 minute period with a specified applied load (as noted above, 5 kg). An MFI unit of 1 thus indicates that only 1 gram of the toner passed through the orifice under the specified conditions in 10 minutes time, "MFI units" as used herein thus refers to units of grams per 10 minutes.

Toners of the present disclosure subjected to this procedure may have varying MFI depending on the pigment utilized to form the toner. In embodiments, a black toner of the present disclosure may have an MFI from about 30 gm/10 min to about 50 gm/10 min, in embodiments from about 36 gm/10 min to about 47 gm/10 min; a cyan toner may have an MFI from about 30 gm/10 min to about 50 gm/10 min, in embodiments from about 36 gm/10 min to about 46 gm/10 min; a yellow toner may have an MFI from about 12 gm/10 min to about 50 gm/10 min, in embodiments from about 16 gm/10 min to about 35 gm/10 min; and a magenta toner may have an MFI of from about 45 gm/10 min to about 55 gm/10 min, in embodiments from about 48 gm/10 min to about 52 gm/10 min.

In an electrophotographic apparatus, the lowest temperature at which toner adheres to the fuser roll is called the cold offset temperature; the maximum temperature at which the toner does not adhere to the fuser roll is called the hot offset temperature. When the fuser temperature exceeds the hot offset temperature, some of the molten toner adheres to the fuser roll during fixing, is transferred to subsequent substrates (phenomenon known as "offsetting"), and results for example in blurred images. Between the cold and hot offset temperatures of the toner is the minimum fix temperature (MFT), which is the minimum temperature at which acceptable adhesion of the toner to the support medium occurs. The difference between minimum fix temperature and hot offset temperature is called the fusing latitude. As will be recognized by one skilled in the art, the rheology of toners, especially at high temperatures, may be affected by the length of the polymer chain utilized to form the binder resin as well as any crosslinking or the formation of a polymer network in the binder resin.

Toners of the present disclosure may possess cold offset temperatures higher than about 130° C., in embodiments from about 130° C. to about 140° C., in embodiments from about 134° C. to about 137° C., and hot offset temperatures higher than about 180° C., in embodiments from about 190° C. to about 210° C., in embodiments from about 195° C. to about 205° C. The minimum fix temperature for toners of the present disclosure may be from about 135° C. to about 170° C., in embodiments from about 140° C. to about 160° C.

Particles of a non-magnetic SCD toner of the present disclosure may have a volume average diameter of from about 4 microns to about 8 microns, in embodiments from about 5 microns to about 7 microns. The number average geometric size distribution (GSDn) and/or Volume Average Geometric Size Distribution (GSDv) of a toner of the present disclosure may be from about 1.1 to about 1.35, in embodiments from about 1.15 to about 1.25, as determined by a Layson Cell particle analyzer.

The characteristics of the toner particles may be determined by any suitable technique and apparatus. Volume average particle diameter $D_{50v}$, GSDv, and GSDn may be measured by means of a measuring instrument such as a BECKMAN COULTER MULTISIZER 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a BECKMAN COULTER MULTISIZER 3.

Particles of a non-magnetic SCD toner of the present disclosure may have a circularity of from about 0.9 to about 0.99 (measured with, for example, a Sysmex FPIA 2100 analyzer).

Non-magnetic single component development toners of the present disclosure may possess a dynamic viscosity of from about $10^2$ poise to about $10^6$ poise, in embodiments from about $10^3$ poise to about $10^5$ poise. In addition, a non-magnetic SCD of the present disclosure may have an elastic modulus of from about $10^3$ dyne/cm$^2$ to about $10^6$ dyne/cm$^2$, in embodiments from about $10^4$ dyne/cm$^2$ to about $10^5$ dyne/cm$^2$, as measured at 10 rad/second at 120° C.

As noted above, in embodiments, the toner of the present invention may be used as the toner component of various developers, including non-magnetic single component developers. Surface additives, including the large polymeric spacers described above, can be added to the toner compositions of the present disclosure after washing or drying. Surface additives can play an important role in non-magnetic SCD. As toner particles are compressed and sheared between the nip of the charging/metering blade and the development roll, toner particles start to lose their developability. Thus, it is important to maintain the chargeability and flowability of toner throughout the CRU life.

Another property of the toners of the present invention is the excellent cohesivity of the particles. The greater the cohesivity, the less the toner particles are able to flow. Cohesivity may be determined utilizing methods within the purview of those skilled in the art, in embodiments by placing a known mass of toner, for example two grams, on top of a set of about three screens, for example with screen meshes of about 53 microns, about 45 microns, and about 38 microns, in order from top to bottom, and vibrating the screens and toner for a fixed time at a fixed vibration amplitude, for example for about 115 seconds at about a 1 millimeter vibration amplitude. A device which may be utilized to perform this measurement includes the Hosokawa Powders Tester, commercially available from Micron Powders Systems. The toner cohesion value is related to the amount of toner remaining on each of the screens at the end of the time. A cohesion value of 100% corresponds to all of the toner remaining on the top screen at the end of the vibration step and a cohesion value of zero corresponds to all of the toner passing through all three screens, that is, no toner remaining on any of the three screens at the end of the vibration step. The higher the cohesion value, the lower the flowability of the toner.

Toners of the present disclosure may have a cohesivity as determined above utilizing a Hosokawa Powder Tester, for example, from about 5% to about 40%, in embodiments from about 8% to about 28% for all colors utilizing toner of the present disclosure.

Uses

Toner in accordance with the present disclosure can be used in a variety of imaging devices including printers, copy machines, and the like. The toners generated in accordance with the present disclosure are excellent for imaging processes, especially electrophotographic processes such as xerographic processes, which may operate with a toner transfer efficiency in excess of about 90 percent, such as those with a compact machine design without a cleaner or those that are designed to provide high quality colored images with excellent image resolution, acceptable signal-to-noise ratio, and image uniformity. Further, toners of the present disclosure can be selected for electrophotographic imaging and printing processes such as digital imaging systems and processes.

The imaging process includes the generation of an image in an electronic printing apparatus and thereafter developing the image with a toner composition of the present disclosure. The formation and development of images on the surface of photoconductive materials by electrostatic means is within the purview of those skilled in the art. The basic xerographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material referred to in the art as "toner". The toner will normally be attracted to the discharged areas of the layer, thereby forming a toner image corresponding to the latent electrostatic image. This powder image may then be transferred to a support surface such as paper. The transferred image may subsequently be permanently affixed to the support surface as by heat.

Development may occur via discharge area development. In discharge area development, the photoreceptor is charged and then the areas to be developed are discharged. The development fields and toner charges are such that toner is repelled by the charged areas on the photoreceptor and attracted to the discharged areas. This development process is used in laser scanners.

In other embodiments, development may also be accomplished by the magnetic brush development process disclosed in U.S. Pat. No. 2,874,063, the disclosure of which is hereby incorporated by reference in its entirety. This method entails the carrying of a developer material containing toner of the present disclosure and magnetic carrier particles by a magnet. The magnetic field of the magnet causes alignment of the magnetic carriers in a brush like configuration, and this "magnetic brush" is brought into contact with the electrostatic image bearing surface of the photoreceptor. The toner particles are drawn from the brush to the electrostatic image by electrostatic attraction to the discharged areas of the photoreceptor, and development of the image results. In embodiments, the conductive magnetic brush process is used wherein the developer comprises conductive carrier particles and is capable of conducting an electric current between the biased magnet through the carrier particles to the photoreceptor.

Imaging

Imaging methods are also envisioned with the toners disclosed herein. Such methods include, for example, some of the above patents mentioned above and U.S. Pat. Nos. 4,265,990, 4,858,884, 4,584,253 and 4,563,408, the disclosures of each of which are hereby incorporated by reference in their entirety. The imaging process includes the generation of an image in an electronic printing magnetic image character recognition apparatus and thereafter developing the image with a toner composition of the present disclosure. The formation and development of images on the surface of photoconductive materials by electrostatic means is within the purview of those skilled in the art. The basic xerographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material, for example, toner. The toner will normally be attracted to those areas of the layer, which retain a charge, thereby forming a toner image corresponding to the latent electrostatic image. This powder image may then be transferred to a support surface such as paper. The transferred image may subsequently be permanently affixed to the support surface by heat. Instead of latent image formation by uniformly charging the photoconductive layer and then exposing the layer to a light and shadow image, one may form the latent image by directly charging the layer in image configuration. Thereafter, the powder image may be fixed to the photoconductive layer, eliminating the powder image transfer. Other suitable fixing means such as solvent or overcoating treatment may be substituted for the foregoing heat fixing step.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Example 1

EA toner particles were prepared in a batch process. Latex 1 was prepared as follows. To a 2 gallon reactor equipped with a stainless-steel stirrer, condenser, nitrogen inlet, thermometer, I2R thermocouple adapter, and internal cooling coil, the following material was added: About 2902 grams deionized water and about 41 grams sodium dodecyl diphenyloxide disulfonate were charged and brought to an internal temperature of about 75° C. This was allowed to stir at about 150 rpm for a minimum of about 30 minutes under nitrogen flow to displace the oxygen.

A mixture of about 1581 grams styrene, about 58 grams beta carboxyethyl acrylate (β-CEA), about 7 grams dodecanediol diacrylate (A-DOD), about 7.25 grams dodecanethiol and about 354 grams butyl acrylate was produced by dispersing under high shear conditions in a separate mixing vessel to form a homogenous emulsion.

The reactor was then charged with about 30 grams of the aforementioned emulsion as a seed monomer. The seed monomer was allowed to stir for about 10 minutes to disperse the monomer in the water phase with the surfactant. To initiate polymerization, a mixture of about 29 grams ammonium persulfate (APS) dissolved in about 144 mL deionized water was added to the reactor. Once initiation took place, which was evident by a white cloudy appearance, the remaining homogenized emulsion from the mixing vessel was fed in at a controlled rate to grow the particles to their desired size of from about 190 nm to about 260 nm. After monomer addition was complete, the polymerization was allowed to continue for about 2 hours at about 75° C. to complete conversion of monomer to polymer.

The resulting latex, Latex 1 (styrene/butylacrylate resin) had a Mw of about 55 kpse and a Tg of about 55° C. as determined by GPC and DSC).

Toner Synthesis:

E/A toner formulations were made using the aforementioned styrene/butylacrylate resin (Latex 1). The following components were first homogenized, then mixed at about 60° C.: the resin, pigment (colorants being Pigment Yellow 74, Pigment Blue 15:3, Regal 330 black and a combination of Pigment Red 122 and Pigment Red 238), polyethylene wax, and polyaluminum chloride (or other coagulating agent). Particles in the mixture were grown to the desired size of about 5.6 μm. The outer shell was then added until the appropriate particle size was reached of from about 7 μm to about 8 μm, and then growth was halted with the addition of a base such as sodium hydroxide and adjusted to pH of about 4.5. The particles were then coalesced at an elevated temperature of about 98° C. until a potato shape was achieved (measured using the Malvem Sysmex FPIA e3000). Particles were then wet sieved, washed by filtration, and freeze-dried.

The resulting particles were then taken and blended as toner with the addition of a large polymeric spacer including a polymethyl methacrylate (PMMA Spacer) having a size of about 150 nm commercially available as ESPRIX 1451 from Esprix technologies. Other spacers were added to form different toners, including small silica (12 nm octyl silane treated silica); medium silica (40 nm polydimethyl siloxane); and small titania (15 nm rutile titania). Toner was formed by blending in a 10 liter HENSCHEL BLENDER in various amounts.

Toners were then placed into testing (ambient and low relative humidity (RH) conditions, continuous print cycle out) in a HEWLETT PACKARD 3800 SCD machine, using refill cartridges that included the above toners after initial usage (FOC or field one cycle). OEM toners from HEWLETT PACKARD (HP OEM toner), having only silica as surface additive were tested under the same conditions as a control.

Testing of the formulations with 1.25% small silica and 0.3% ESPRIX 1451 from Esprix Technologies showed low background, no toner additive buildeup (TAB), minor mottle and no cleaning defect issues. (See Table 1 below.) Q/M off the Developer is summarized below in Table 1.

TABLE 1

Q/M off the Developer Roll (DAA 3800 Machines)
Print Count OEM Example 1 (K)

| | C | Y | M | K | small silica, small titania | PMMA spacer, small silica | Medium silica, small silica |
|---|---|---|---|---|---|---|---|
| 0 kp | 41 | 49 | 52 | 38 | 10 | 26 | 17 |
| 4 kp | 31 | 23 | 23 | 24 | 7 | 14 | 12 |
| Ratio | 0.76 | 0.47 | 0.44 | 0.63 | 0.60 | 0.54 | 0.71 |

Small silica is 12 nm silica (octyl silane).
Small titania is (15 nm rutile) titania.
Medium silica is (40 nm PDMS) silica.

Additional data was generated by print testing and performance measurements, with the additive package and results summarized in Table 2 below. 5 samples were run with various additive packages (test 1-test 5). The control was an OEM toner from HEWLETT PACKARD, including a styrene/butyl acrylate resin having a particle size of approximately 7 μm and a circularity of about 0.98. This toner included Pigment yellow 93, a Pigment red 122 combination, Pigment blue 15:3, and a carbon black. The toner also possessed approximately 1.2% small, surface silica, that was tightly adhered thereto.

TABLE 2

| | Test 1 | Test 2 | Test 3 | | Test 4 | | Test 5 | | Control |
|---|---|---|---|---|---|---|---|---|---|
| Additive Design | small additives | 1.25% small silica + 0.3% PMMA | 1.25% small silica + 0.3% PMMA + 0.25% CCA | | 1.25% small silica + 0.3% PMMA + 0.25% CCA (blend Energy increase) | | 1.25% small silica * 0.3% PMMA + 0.26% CCA 8 (blend Energy increase) | | 1.2% surface silica |
| Ave SAD | 1.19 | 1.28 | 1.40 | 1.39 | 1.42 | 1.40 | 1.42 | 1.40 | 1.42 |
| SAD St Dev | 0.16 | 0.07 | 0.06 | 0.10 | 0.07 | 0.07 | 0.07 | 0.07 | 0.06 |
| Back ground | 62% level 3 38% level 2 | 13% level 3 50% level 2 | 13% level 2 (went away) | none | 17% level 2 | ok | ok | ok | 30% level 2, 20% level 3 |
| Tab | 13% level 3 | 75% level 3 | 13% level 3 13% | 40% level 3 | 33% level 2 | 20% level 2 | ok | ok | ok |
| Cleaning | 25% level 3 | ok | ok | ok | ok | ok | ok | ok | ok |
| Mottle/reload | 50% level 3 13% level 2 | 50% level 3 50% level 2 | 13% level 2 | ok | 33% level 2 | ok | 33% level 2 | ok | 40% level 2, 10% level 3 |
| Ave. Yield | 6356 | 7639 | 6953 | 7093 | 6867 | 6524 | ~7600 | ~8300 | 7540 |
| Yield St. Dev | 820 | 1446 | 1079 | 1096 | 914 | 616 | ~870 | 0 | 740 |
| Filming | none noted | 25% observations | 13% level 3 13% level 2 | 60% level 3 20% level 2 | 67% level 2 | 20% level 3 20% level 2 | ok | ok | ok |

small additives = Small silica (12 nm silica (octyl silane))

E-88 is BONTRON ® E-88 (from Hodogaya Chemical), a mixture of hydroxyaluminium-bis[2-hydroxy-3,5-di-tert-butylbenzoate] and 3,5-di-tert-butylsalicylic acid.

Print testing data is set forth in the FIGURE, which is a graph of the Q/M off the developer roll. The diamonds represent the toner with both BONTRON E88 and the ESPRIX material incorporated, which increased the charge at low levels. The triangles represent the toner having just the BONTRON E88 alone. Data was generated on a SCD printer. Prints were examined for solid area density (SAD); background (level 0 being none seen, level 4 worst) percentage based upon number of samples; TAB was the toner additive buildup yielding print defects; cleaning was what was not cleared from the machine and ended up on the prints as smudges; mottle was the poor homogeneity of the image; reload was caused by the poor flow of the toner creating light and dark pattern differences; yield was the number of prints per cartridge; and filming was the print defect caused by a buildup of additives in the machine decreasing the image quality.

The FIGURE shows that having the very large spacer aided the charging against the Doctor Blade, resulting in high Q/M, thereby improving solids and background. As can be seen from the FIGURE, the cyan toner formulation performed similarly to the OEM toner, and showed excellent density and life performance. The yellow formulation (same as the cyan additive package) showed good density and life properties with similar characteristics as the OEM toner. The data showed that having the very large spacer helped with the charging against the Doctor Blade, resulting high Q/M thereby improved solid and background.

The black formulations using the 1.25% silica and 0.3% PMMA spacers were shown to have problems with end of life background, TAB (toner additive buildup) throughout life and mottle. Formulations with 0.05% CCA showed improvement but some TAB issues were still evident. By incorporating 0.2% more CCA in the toner it was shown that the TAB and background were farther reduced and density and life performance were excellent. This was demonstrated in both the ambient and dry zones with equally acceptable results. Improvement in Q/M was obtained by adding a small amount of external CCA to the design.

The magenta toner had similar issues with performance using just the 1.25% silica and 0.3% PMMA spacer. Additional incorporation of titania at 0.05% provided better controlled RH sensitivity. The PMMA level was decreased to 0.2% to improve issues with toner additive buildup (TAB). The result was a formulation of 1.25% silica, 0.2% PMMA spacers and 0.05% titania. This formulation showed print defects in background, TAB vertical line, mottle and density inconsistency. Additional work was done to augment this formulation by keeping the silica at 1.25%, the titania at 0.05%, reducing the PMMA spacers to 0.15%, and adding 0.05% CCA. This resulted in reduced background issues and moderation of the TAB, but an improvement in density consistency and page life. Further adjustment of this formulation by the addition of 0.2% CCA showed improved density and page life.

As can be seen from the above data, the addition of a large polymeric spacer (PMMA) to cyan and yellow toners at levels of from about 0.1% to about 0.5% improved print performance metrics such as background and solid area density (SAD) compared with controls that only possessed silica, as well as a slight increase in triboelectric charge. The addition of CCA to the magenta and black toners resulted in no background issues, good solid area density, and good life.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A single component toner comprising: a latex resin; and at least one surface additive comprising a large polymeric spacer having a volume average diameter of from about 90 nm to about 700 nm, wherein the large polymeric spacer has been surface treated with a combination of silicon and zinc so that the silicon is present in an amount of from about 40 ppm to about 120 ppm, and the zinc is present in an amount of from about 1200 ppm to about 4000 ppm.

2. The single component toner according to claim 1, wherein the latex resin is selected from the group consisting of styrene acrylates, styrene butadienes, styrene methacrylates, polyesters, and combinations thereof.

3. The single component toner according to claim 1, wherein the large polymeric spacer is selected from the group consisting of polystyrenes, fluorocarbons, polyurethanes, polyolefins, polyesters, and combinations thereof.

4. The single component toner according to claim 1, wherein the large polymeric spacer is selected from the group consisting of high molecular weight polymethylenes, high molecular weight polyethylenes, high molecular weight polypropylenes, polymethyl methacrylate, styrene acrylates, polystyrene, fluorinated polymethylmethacrylate, and combinations thereof, present in an amount of from about 0.01% to about 1.25% by weight of the toner particles.

5. The single component toner according to claim 1, wherein the toner comprises a non-magnetic emulsion aggregation toner, further comprises a colorant, and optionally one or more components selected from the group consisting of surfactants, coagulants, and optionally mixtures thereof, and the large polymeric spacer has a volume average diameter of from about 100 nm to about 500 nm.

6. The single component toner of claim 1, wherein the latex resin comprises a styrene/butyl acrylate copolymer, and wherein the toner further comprises a second latex resin forming a shell over the latex resin.

7. The single component toner of claim 1, wherein the toner possesses a triboelectric value of from about 40 μC/g to about 90 μC/g and a surface area from about 0.8 $m^2/g$ to about 3.5 $m^2/g$.

8. A single component toner comprising: a latex resin selected from the group consisting of styrene acrylates, styrene butadienes, styrene methacrylates, and combinations thereof; and at least one surface additive comprising a large polymeric spacer selected from the group consisting of styrene acrylates, polystyrenes, fluorocarbons, polyurethanes, polyolefins, polyesters, and combinations thereof, having a volume average diameter of from about 90 nm to about 700 nm, wherein the large polymeric spacer has been surface treated with a combination of silicon and zinc so that the silicon is present in an amount of from about 40 ppm to about 120 ppm, and the zinc is present in an amount of from about 1200 ppm to about 4000 ppm.

9. The single component toner according to claim 8, wherein the large polymeric spacer is selected from the group consisting of high molecular weight polymethylenes, high molecular weight polyethylenes, high molecular weight polypropylenes, polymethyl methacrylate, styrene acrylates, polystyrene, fluorinated polymethylmethacrylate, and combinations thereof, present in an amount of from about 0.01% to about 1.25% by weight of the toner particles.

10. The single component toner according to claim 8, wherein the toner comprises a non-magnetic emulsion aggregation toner, further comprises a colorant, and optionally one or more components selected from the group consisting of surfactants, coagulants, and optionally mixtures thereof, and the large polymeric spacer has a volume average diameter of from about 100 nm to about 300 nm.

11. The single component toner of claim 8, wherein the latex resin comprises a styrene/butyl acrylate copolymer, and wherein the toner further comprises a second latex resin forming a shell over the latex resin.

12. The single component toner of claim 8, wherein the toner possesses a triboelectric value of from about 40 μC/g to about 90 μC/g and a surface area from about 0.8 $m^2/g$ to about 3.5 $m^2/g$.

* * * * *